US007794169B2

(12) United States Patent
Sasamoto et al.

(10) Patent No.: US 7,794,169 B2
(45) Date of Patent: Sep. 14, 2010

(54) BOOKBINDING APPARATUS

(75) Inventors: Shinya Sasamoto, Hokuto (JP); Tadahito Takano, Fuefuki (JP)

(73) Assignee: Nisca Corporation, Minamikoma-gun (JP)

( * ) Notice: Subject to any disclaimer, the term of this patent is extended or adjusted under 35 U.S.C. 154(b) by 56 days.

(21) Appl. No.: 11/743,166

(22) Filed: May 2, 2007

(65) Prior Publication Data

US 2007/0280805 A1 Dec. 6, 2007

(30) Foreign Application Priority Data

May 2, 2006 (JP) ..... 2006-128706

(51) Int. Cl.

| | |
|---|---|
| ***B42C 13/00*** | (2006.01) |
| ***B42C 11/02*** | (2006.01) |
| ***B42C 11/04*** | (2006.01) |
| ***B42B 9/00*** | (2006.01) |
| ***G03G 15/00*** | (2006.01) |

(52) U.S. Cl. ..... 402/22; 402/11; 402/13; 402/19; 402/20; 402/21; 399/408

(58) Field of Classification Search ..... 412/4, 412/5, 8, 10–11, 13–14, 19–23, 37, 29; 399/408
See application file for complete search history.

(56) References Cited

U.S. PATENT DOCUMENTS 4,904,138 A * 2/1990 Champeaux et al. ..... 412/8
5,061,138 A * 10/1991 Allsopp et al. ..... 412/4
6,206,358 B1 * 3/2001 Yamaguchi et al. ..... 270/52.02
6,447,230 B1 * 9/2002 Takai et al. ..... 412/14
6,796,553 B2 * 9/2004 Hampel ..... 270/52.18
2003/0012622 A1 * 1/2003 Itoh et al. ..... 412/37

* cited by examiner

*Primary Examiner*—Dana Ross
*Assistant Examiner*—Kyle Grabowski
(74) *Attorney, Agent, or Firm*—Judge Patent Associates

(57) ABSTRACT

In binding a cover sheet together with a sheet bundle, ever-accurate spine-creasing irrespective of bundle thickness is made possible. A sheet stacker stacks sheets into bundles, an adhesive applicator applies adhesive to a spine part of the sheet bundles, and a cover-sheet binder binds cover sheets together with the spine parts. The cover-sheet binder is constituted from a left-and-right pair of spine-creasing press members arranged free to shift between standby and spine-creasing positions; a shifter that reciprocates the spine-creasing press members between the standby and spine-creasing positions; and a controller. The controller functions to vary, in accordance with sheet bundle thickness, any of: (1) the standby position of the press members; (2) the start time of an operation whereby the press members are shifted from the standby to the spine-creasing position; or (3) the traveling speed of the press members in shifting from the standby to the spine-creasing position.

15 Claims, 10 Drawing Sheets

BOOKBINDING APPARATUS

BACKGROUND OF THE INVENTION

1. Technical Field

The present invention—involving bookbinding apparatuses that collate sheets onto which images have been formed in an image-forming or like apparatus, and that bind them into books by applying adhesive to the spine part of blocks of the sheets and binding them together with a cover sheet—relates to casing-in bookbinding apparatuses that join sheet blocks, onto the spine part of which glue has been applied, to the middle portion of a cover sheet, and spine-crease the cover sheet.

2. Description of the Related Art

Generally, this kind of bookbinding apparatus is used as a terminal device to an image forming apparatus, such as a printer, printing press, or the like. Widely used among such apparatuses are automated bookbinding systems that stack image-bearing sheets in page order to collate them into blocks, then apply glue to an endface of a block and encase it with cover sheet. Also in wide use are bookbinding apparatuses that collate into sets printed sheets delivered from a discharge outlet, then encase the sets in cover sheets. A variety of systems have been proposed that print documents, and at the same time execute the bookbinding process that automatically binds and covers the documents to form a booklet. A recent particular example is on-demand printing systems, known in electronic publishing.

As an example of such a system, Japanese Unexamined Pat. App. No. 2004-209869 discloses an apparatus configuration that automatically finishes booklets of sheets received from an image forming apparatus. This patent publication also discloses an adhesive application process wherein sheets received from an image forming apparatus discharge outlet are guided to a sheet conveyance path, and stacked substantially horizontally at a stacking tray disposed downstream in that path. The horizontally stacked sheet bundle is rotated substantially 90 degrees to be guided to an adhesive applicator apparatus. An apparatus that folds a cover sheet supplied from an inserter over a sheet bundle applied with adhesive is also disclosed.

Bookbinding schemes such as the conventional bookbinding system are known to join the glued spine part of a sheet bundle to a center of a cover sheet conveyed orthogonally to the direction of sheet bundle conveyance and fold the cover sheet over the sheet bundle, thereby forming a booklet. In conventional apparatuses, a pair of spine-creasing press members (disposed at left and right sides of a creasing position) presses the cover sheet joined at its center to the sheet bundle. Therefore, a structure is adopted wherein the pair of spine-creasing press members forms a pressing shape. The pressing members mutually approach each other from their standby positions, separated a distance at left and right sides based on a central spine-creasing position, to fold the spine part of the cover sheet at the central spine-creasing position.

Thus, when the cover sheet is folded over the glued sheet bundle, the sheet bundle and cover sheet spine part are press-formed by the pair of spine-creasing press members. In this case, the left and right of the pair of press members are positioned at their standby positions, such as their home positions. They press-form the spine part of the cover sheet over the sheet bundle when they move from the standby positions to a creasing position (or spine-creasing position). Therefore, there are problems, outlined below, caused by differences in sheet bundle thickness. Firstly, if the left- and right-side spine-creasing press members do not reach and press against the spine part of the sheet bundle at the same time, the sheet bundle can be pushed out of position. That invites unsightly damage to the finished booklet. Secondly, if it takes a long time for the left- and right-side spine-creasing press members to reach the spine part of the sheet bundle from their standby positions, there is the possibility that the adhesive will harden or solidify, depending on the ambient temperature. If that should occur, the cover sheet will not fold properly over the spine part of the sheet bundle. This situation leads to unevenness or even wrinkles in the finished booklet.

Conversely, if the press members move too quickly to fold the cover sheet over the spine part of the sheet bundle, there is the problem that the softened adhesive will bleed through the cover sheet and ruin the finished booklet. Adhesive used when binding a booklet requires certain contradictory conditions for an optimum finished product. Specifically, adhesive must be adequately viscid to be able to permeate between the leaves of the sheet bundle, yet it must attain a proper degree of hardness when the cover sheet is folded over the sheet bundle for a clean fold. Furthermore, once the cover sheet has been folded, the adhesive must solidify in a short amount of time.

On the other hand, sheet bundles will vary in thickness, so the conditions for folding a cover sheet over a thick or a thin bundle will also vary. Conventional left- and right-side spine-creasing press members approach each other from predetermined standby positions at a predetermined speed, and fold the cover sheet at a predetermined creasing position. Therefore, if the thicknesses of sheet bundles are different, the timing for those left- and right-side spine-creasing press members to reach the creasing position will also vary accordingly. This can lead to the spine-creasing position varying to the left or right sides, and again produce an improperly folded booklet. Even if the problem of mis-positioning is overcome, the spine-creasing press members reach a thick sheet bundle more quickly from their standby positions, and take a longer amount of time for thinner sheet bundles. Thus, the degree of adhesive solidification at the time of the cover sheet folding operation varies depending on the thickness of the sheet bundle.

Conventionally, to solve the aforementioned problems, various measures have been attempted, such as using a slower drying/hardening adhesive or standing by until the adhesive has reached a sufficient degree of hardness before folding the cover sheet. However, these measures result in extended production times to finish booklets. Thus, an object of the present invention is to provide a bookbinding apparatus that accurately folds a cover sheet over a sheet bundle regardless of the sheet bundle thickness, and completes the bookbinding process in a short amount of time without negatively affecting the aesthetic appearance of the finished booklet after the bookbinding process.

BRIEF SUMMARY OF THE INVENTION

The present invention employs the following configuration to solve the aforementioned problems. The present invention provides sheet stacking means that stack sheets in a bundle; adhesive application means that applies adhesive to a spine part of the sheet bundle conveyed from the sheet stacking means; and cover-sheet binding means that binds a cover sheet to a spine part of the sheet bundle conveyed from the adhesive application means. The cover-sheet binding means is composed of a left- and right-side pair of spine-creasing press members at least one thereof disposed to move between a standby position and a spine-creasing position; shift means that reciprocates the spine-creasing press members between the standby position and the spine-creasing position; and control means that controls the shift means.

The control means is provided at least one of the following means to correspond to the thickness of the sheet bundle: (1) means that varies the standby position of the press members; (2) means that varies the operation start time to move the press members from the standby position to the spine-creasing position; and (3) means that varies the traveling speed of the press members to move from the standby position to the spine-creasing position. It is possible to make the timing for the spine-creasing press members that fold the cover sheet over the sheet bundle to move from their standby positions to the spine-creasing position constant regardless of the sheet bundle thickness, and to accurately fold the cover sheet over the spine part of the sheet bundle at the spine-creasing position for a sharp finish, without the thickness of the sheet bundle negatively affecting the status (degree of hardness) of the adhesive. Therefore, an aesthetically attractive booklet can be produced. Also, either sheet bundle thickness detection means that directly detects the thickness of the sheet bundle is disposed, or counting means that counts the number sheets in the bundle to calculate the thickness can be adopted.

The control means controls the shift means to vary the distance from the standby positions of the spine-creasing press members to the spine-creasing position according to the thickness of the sheet bundle; the control means sets the distance from the standby position to the spine-creasing position to be shorter as the sheet bundle becomes thinner. This makes it possible for the spine-creasing press members to reach from their starting position to the spine-creasing position at substantially the same amount of time each time, regardless of the thickness of the sheet bundle. Particularly, if the sheet bundle is thin and a small amount of adhesive has been applied to a spine part thereof, the spine-creasing press members execute the cover sheet folding operation prior to the adhesive hardening, thereby achieving an accurately folded booklet.

The control means controls the shift means to vary the operation start time according to the thickness of the sheet bundle when the spine-creasing press members are moved from the predetermined standby positions to the spine-creasing position; the control means moves forward in time the start time for the operation as the sheet bundle becomes thinner. This also delays the spine-creasing press members when handling a thick sheet bundle, and starts the movement earlier for thinner sheet bundles. This method executes the folding operation prior to the hardening of the adhesive when handling thin sheet bundles.

The control means controls the shift means to vary the spine-creasing press members speed of movement according to the thickness of the sheet bundle when they are moved from the predetermined standby positions to the spine-creasing position; the control means increases the traveling speed as the sheet bundle becomes thinner. Therefore, in the same way as was described above, the spine-creasing press members execute the folding operation when the adhesive is at an optimum hardness. Note that the sheet stacking means, adhesive application means and cover-sheet binding means are sequentially disposed in a sheet conveyance path that conveys sheet bundles. A cover sheet feeding path is disposed to intersect a sheet bundle conveyance in path at a perpendicular position where the cover-sheet binding means is disposed. Gripping conveyance means that conveys sheet bundles is disposed at the sheet bundle conveyance in path. Adhesive is applied to a spine part of the sheet bundle in the process to be moved through the sheet bundle conveyance in path by the gripping conveyance means, a cover sheet is joined to the sheet bundle, and the folding operation is executed.

Another aspect of the present invention is to provide sheet stacking means that stack sheets in a bundle; adhesive application means that applies adhesive to a spine part of the sheet bundle conveyed from the sheet stacking means; and cover-sheet binding means that binds a cover sheet to a spine part of the sheet bundle conveyed from the adhesive application means. The cover-sheet binding means is composed of a left- and right-side pair of spine-creasing press members at least one thereof disposed to move between a standby position and a spine-creasing position; shift means that reciprocates the spine-creasing press members between the standby position and the spine-creasing position; and control means that controls the shift means.

The control means controls the shift means to hold the spine-creasing press members in place at the spine-creasing position when they have folded the cover sheet over the sheet bundle. This holding time can be varied according to the basis weight (or more precisely, grammage) of the sheet bundle, the material and/or the thickness of the sheet bundle. This makes it possible for the adhesive to securely harden between the sheet bundle and cover sheet after the folding process by the spine-creasing press members to ensure a quality bond. Note that in such case, the control means controls the shift means to hold the spine-creasing press members at the spine-creasing position for the holding time preset according to the grammage or the thickness of the sheet bundle. If the grammage of the sheet bundle is high, or the sheet bundle is thick, the control means lengthens the holding time.

Also, the control means controls the shift means to slow the traveling speed of the spine-creasing press members as they approach the spine-creasing position when they are moved from their standby positions to the spine-creasing position. This makes it possible to achieve a fold at a uniform thickness without the still-softened adhesive bleeding out from the spine part of the sheet bundle or cover sheet. Also, the control means controls the shift means to increase the traveling speed of the spine-creasing press members as they separate from the spine-creasing position when they are moved from the spine-creasing position to their standby positions. This shortens the bookbinding processing time.

The present invention changes the distances of the standby positions, the startup timing and the movement speeds of the left- and right-side pair of spine-creasing press members according to the thickness of the sheet bundle to enable a sharp fold at an accurate creasing position without the degree of adhesive hardness being affected by the thickness of the sheet bundle. Particularly, the present invention makes it possible to create a booklet that is aesthetically appealing. When the sheet bundle is thin and a lesser amount of adhesive is applied, that adhesive will not harden prior to the folding operation of the spine-creasing press members and cause unevenness in the spine part cover. Conversely, if the sheet bundle is thick, and the adhesive is still soft, it will not bleed to the outside when the cover sheet is folded over the sheet bundle.

DETAILED DESCRIPTION OF THE INVENTION

Figure 1:
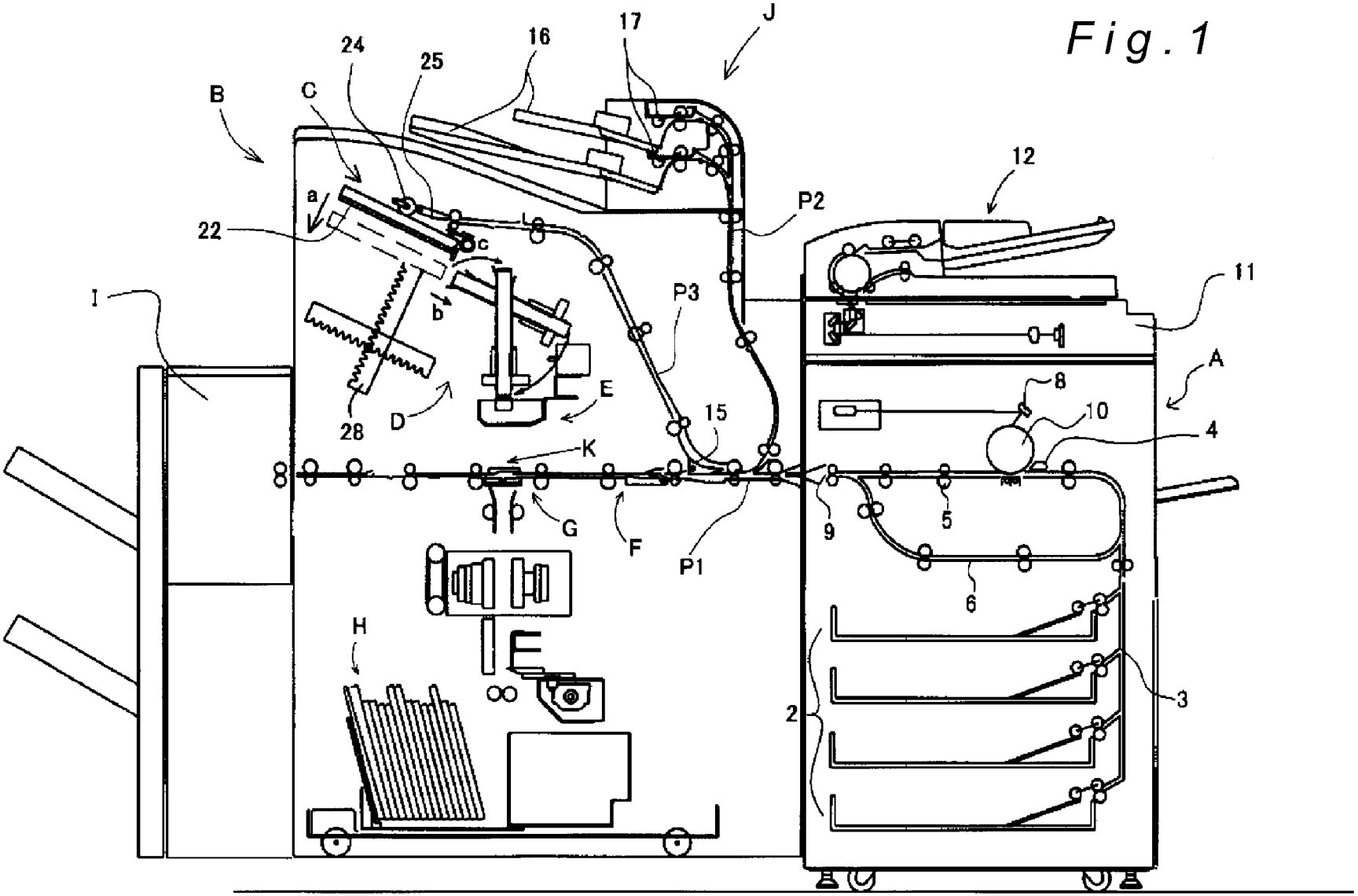
FIG. 1 shows the overall configuration of an image forming system equipped with the bookbinding apparatus of the present invention.
Figure 2:
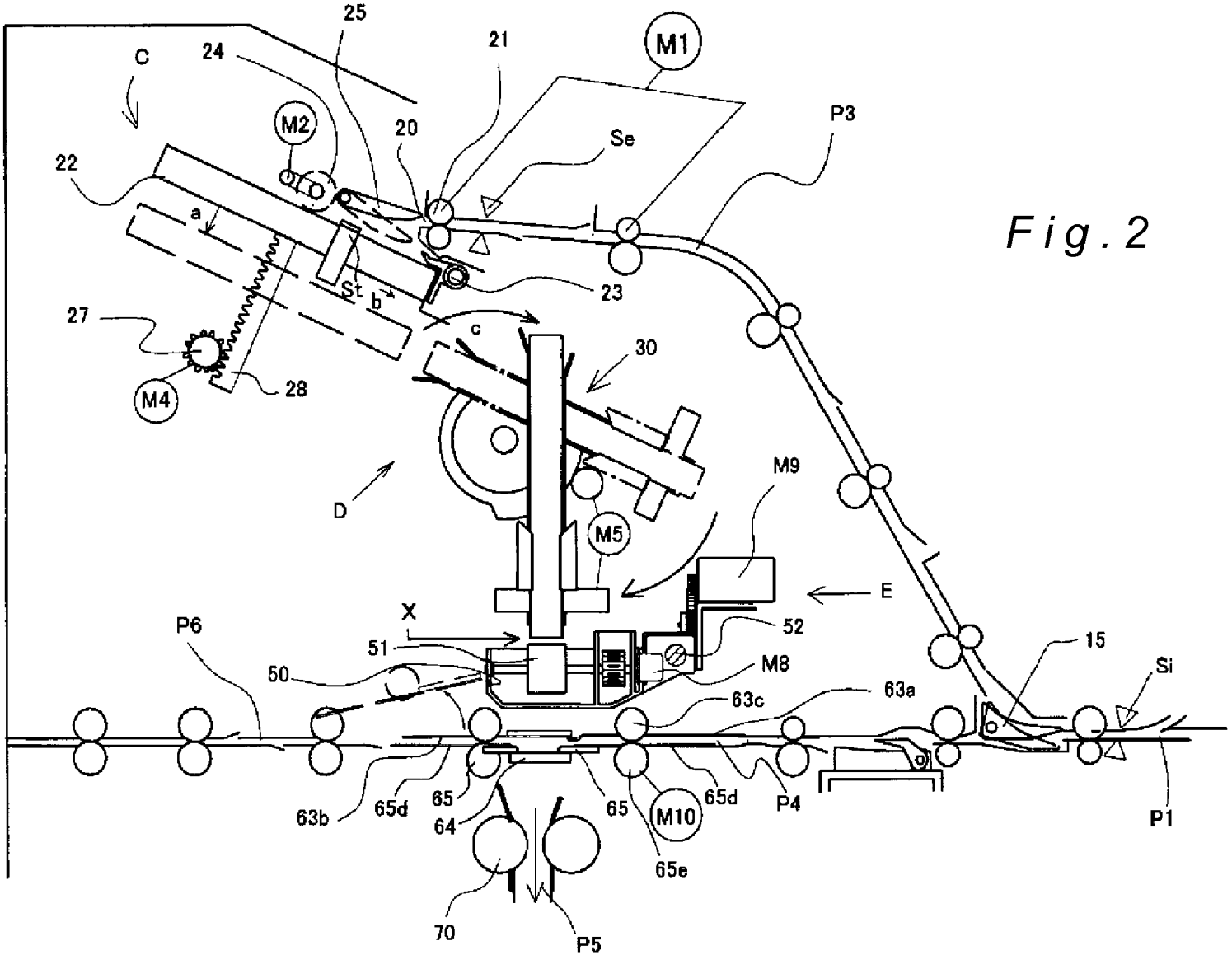
FIG. 2 is an expanded view of the essential portion of the bookbinding apparatus of FIG. 1.

Preferred embodiments of the present invention will now be explained with reference to the drawings provided. FIG. 1 is an explanatory view of the overall configuration of the bookbinding apparatus according to the present invention; FIG. 2 is an expanded view of the essential part thereof.

The bookbinding apparatus of the present invention, as shown in FIG. 1, is connected to an image forming apparatus A. The bookbinding apparatus aligns sheets formed with images at the image forming apparatus A into a sheet bundle, then applies adhesive to the spine part of the sheet bundle. Finally, a cover sheet is joined to and pressed against the spine part of the sheet bundle thereby forming a booklet by that apparatus. The cover sheet is supplied from the image forming apparatus or an inserter device from a perpendicular direction that intersects the sheet bundle conveyance in path. FIG. 1 shows such an image forming system. The following will now explain the image forming apparatus A and bookbinding apparatus B.

The image forming apparatus A shown in the drawing is incorporated into a system composed of a computer, and word-processor and the like. The surfaces of documents in a series are printed, and the documents are discharged from a discharge outlet 9. A laser, ink-jet or offset printing method can be adopted as printing means in the image forming apparatus A. FIG. 8 shows a printing drum 10, such as an electrostatic drum; a paper feed cassette 2 that feeds sheets to the printing drum 10; a print head 8, such as a laser, to form images on the printing drum 10; a developer 4; and a fixer 5. Sheets of a predetermined size are feed from the paper feed cassette 2 to the sheet supply path 3; the printing drum is disposed in this path 3. An electrostatic latent image is formed by the print head 8 on the printing drum 10, and the developer adheres toner ink to the latent image. After the toner image formed on the printing drum 10 is transferred to a surface of the sheet, it is fixed thereto by the fixer 5, and the sheet is then discharged from the discharge outlet 9.

A turn-over path 6 is a duplex path for printing to a back surface of a sheet by turning over the sheet printed with an image, from front to back, and guiding it to the printing drum 10 again. The image reading apparatus 11 is composed of a platen that supports a placed original sheet; a scanning carriage that reciprocates along the platen; and photoelectric conversion elements, such as a CCD, that photo-electrically converts original images scanned by the scanning carriage. The original feeder device 12 is equipped with a tray that sets originals; a conveyance path that guides originals from the tray to the platen; and a discharge tray so that the feeder device can automatically supply originals to the platen. Data of the original read by the image reading apparatus is transferred to the data storage unit at the print head 8. The data storage unit is connected to an external device such as a computer, word-processor or the like, and receives original data from the external device.

The bookbinding apparatus B is composed of a sheet stacking means C that stacks in page order sheets sequentially conveyed from the discharge outlet 9 of the image forming apparatus A and aligns the sheets into a sheet bundle; a bundle conveyance unit D that conveys the sheet bundle from the sheet stacking means C along the bookbinding path (hereinafter referred to as a sheet bundle conveyance in path); adhesive applicator means E disposed at a predetermined adhesive application position in the bookbinding path to apply adhesive to a back edge of the sheet bundle; cover sheet conveyance means F that supplies and sets a cover sheet at a binding position disposed at a downstream side of the adhesive application position; a binding unit G disposed at a binding position to join the cover sheet and sheet bundle; and a storage stacking unit H that stores the finished sheet bundle booklet. The configuration of each of the above will be described below.

Sheet Stacking Means

As shown in FIG. 1, a sheet conveyance in path P1 is connected to the discharge outlet 9 of the image forming apparatus A described above. This sheet conveyance in path P1 is disposed substantially horizontally, and is composed of a path that traverses the center of the apparatus. A paper feed path P2 of the inserter J (described below) that feeds the cover sheet and the center binding sheet conveyance path P3 that conveys sheets from the image forming apparatus A are connected to the sheet conveyance in path P1. A path switching flapper 15 is disposed at the path branching point. The center binding sheet conveyance path P3 is disposed to guide sheets from the sheet conveyance in path P1 disposed in the center of the apparatus, to above the apparatus; a discharge roller (sheet conveyance means) and sheet sensor Se are disposed at the discharge outlet 20.

The stacking tray 22 is disposed at a downstream side of the center binding sheet conveyance path P3 to form a level below the discharge outlet 20. A sheet guide 25, aligning roller 24, and a trailing edge aligning member 23 that aligns the positions of the trailing edges of the sheets are disposed at the stacking tray 22. The sheet guide 25 is composed of a guide member that guides sheets from the discharge outlet to the top of the stacking tray 22; the aligning roller 24 conveys sheets advancing in to the tray along the sheet guide 25 to the discharge direction (the left direction of FIG. 2), then after the trailing edge of the sheet advances into the tray, the sheet is switched back in the opposite direction (the right direction in FIG. 2). The trailing edge of the sheet is aligned by striking the trailing edge aligning member 23. The aligning roller 24 is connected to a drive motor M2 capable of both forward and reverse rotation. The sheet guide 25 is configured to be rockable so as to guide sheets from the discharge outlet to the stacking tray 22 when sheets are switched back to engage the trailing edge aligning member 23; a drive means, such as an actuating solenoid, not shown, are connected thereto.

Aligning means, not shown, that aligns the crosswise direction of sheets is equipped on the stacking tray 22. The aligning means is disposed to move a pair of aligning plates (for example on the left and right sides) to align sheets to a sheet side or to a center of the tray. At least one of the aligning plates is reciprocated by a drive motor. The stacking tray 22 can be fastened to the apparatus frame, but the drawing shows the stacking tray installed to the apparatus frame to move up and down between a stacking position and a conveyance position of FIG. 8. A rack 28 equipped on a side of the stacking tray 22 is mated to a pinion 27 connected to a tray raising motor M4. The forward and reverse drives of the motor M4 raise and lower the stacking tray 22 between the stacking position (solid lines in FIG. 1) and the conveyance position (broken lines in FIG. 1). Therefore, sheets stacked on the stacking tray 22 are lowered in the direction of the arrow "a" from the stacking position, and move in the direction of the arrow b, then transferred to the gripping conveyance means 30.

A thickness detection means St is disposed that detects the thickness of the sheet bundle stacked on the stacking tray 22. The detection means, with a Slidac™ sensor, for example, detects the position of the gripper that grips the sheets on the stacking tray 22, and from a resistance value detects the thickness of the sheet bundle. These sheet bundle thickness detection means detect the thickness of a sheet bundle stacked on the stacking tray 22. (1) The gap between the adhesive applicator roll, described below, and the sheet bundle is set to correspond to the thickness of the sheet bundle. (2) The setting position of the cover sheet is adjusted to correspond to the amount of feed for the cover sheet and the thickness of the sheet bundle, and the sheet bundle is set to match the center of the cover sheet. (3) The starting position (standby position) of the spine creasing press means, described below, is adjusted to correspond to the sheet bundle thickness. This is used in the following finishing operation. Therefore, the sheet bundle thickness detection St can employ a variety of thickness detection methods such as by counting the number of sheets using the sheet sensor Se of the discharge outlet 20 and by multiplying the average thickness of a sheet.

Bundle Conveyance Unit

Figure 3:
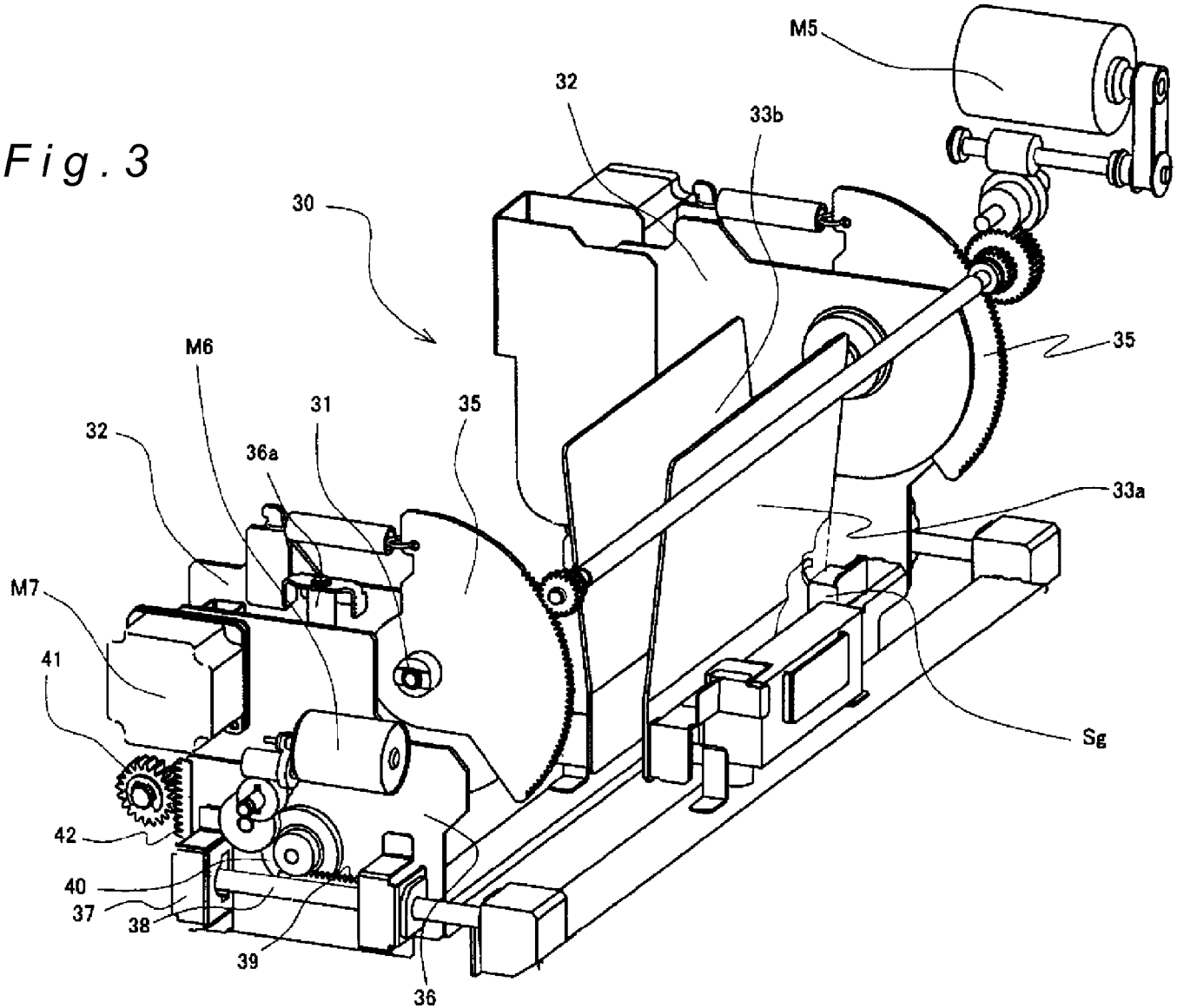
FIG. 3 is an explanatory drawing of a configuration of the gripping conveyance means in the apparatus of FIG. 2.

The bundle conveyance unit D that conveys a sheet bundle from the stacking tray 22 to the downstream side adhesive application position is composed of the gripping conveyance means 30 as shown in FIG. 3. The gripping conveyance means 30 is disposed at the bookbinding path P5 disposed to longitudinally traverse the bookbinding apparatus B. This means deviates the sheet bundle received in a substantially horizontal posture from the stacking tray 22 to a substantially vertical posture by rotating 90 degrees, and conveys the sheet bundle to the adhesive application position at the downstream side. For that reason, the gripping conveyance means 30 is composed of a pair of dampers 33*a*, 33*b* that grip the sheet bundle, and a unit frame 32 that is equipped with both clampers. Also, this unit frame 32 is rotatably supported on the apparatus frame by the shaft 31. By rotatingly driving the fan-shaped gear 35 equipped on the shaft 31 by the motor M5 equipped on the apparatus frame, the unit frame 32 revolves in the clockwise direction and counterclockwise direction of FIG. 2.

A movable frame 36 is matingly supported to move in up and down directions on the guide rail 36*a* (a portion thereof shown in FIG. 3) disposed on the unit frame 32 rotatably born on the apparatus frame. The pinion 41 connected to the elevator motor M7 equipped on the unit frame 32 and the rack 42 equipped on the movable frame 36 are mated. The pair of dampers 33*a*, 33*b* on the movable frame 36 is mounted in the following way. The fixed side clamper 33*b* is fastened to the left and right side frames that compose the movable frame 36 at a width size to grip sheets; a rod 38 is disposed on the movable side damper 33*a*, the rod 38 matingly supported by the bearing 37 on the movable frame 36. A pinion of the grip motor M6 is matingly connected to the rack 39 integrally formed with the rod 38.

Therefore, the dampers 33*a*, 33*b* execute the gripping operation to grip the sheet bundle using the grip motor M6. The motor M5 deviates the gripped sheet bundle Sa from a horizontal posture to a vertical posture, then an elevator motor M7 moves the vertically arranged sheet bundle to the downstream adhesive applicator position along the bookbinding path P5. The grip end sensor Sg disposed on the movable damper 33*a* detects whether the sheet bundle has been securely gripped with the predetermined pressure. When the movable damper 33*a* is moved in the clamping direction to grip the sheet bundle by the grip motor M6, it approaches the fixed damper 33*b* thereby gripping the sheet bundle. When the sheet bundle has been gripped, the gripping sensor Sg turns ON and the grip motor M6 drives a predetermined amount after that signal. This causes the movable damper 33*a* to further approach the fixed damper 33*b* while overcoming an urging spring, not shown, when the sheet bundle is gripped. It then stops to enable the sheet bundle to be gripped at a predetermined pressure. In this state, the gripping conveyance means 30 is moved downward in FIG. 2 by the elevator motor M7 while gripping the sheet bundle and moves the sheet bundle Sa to the downstream to the adhesive application position X.

Adhesive Application Means

Figure 4:
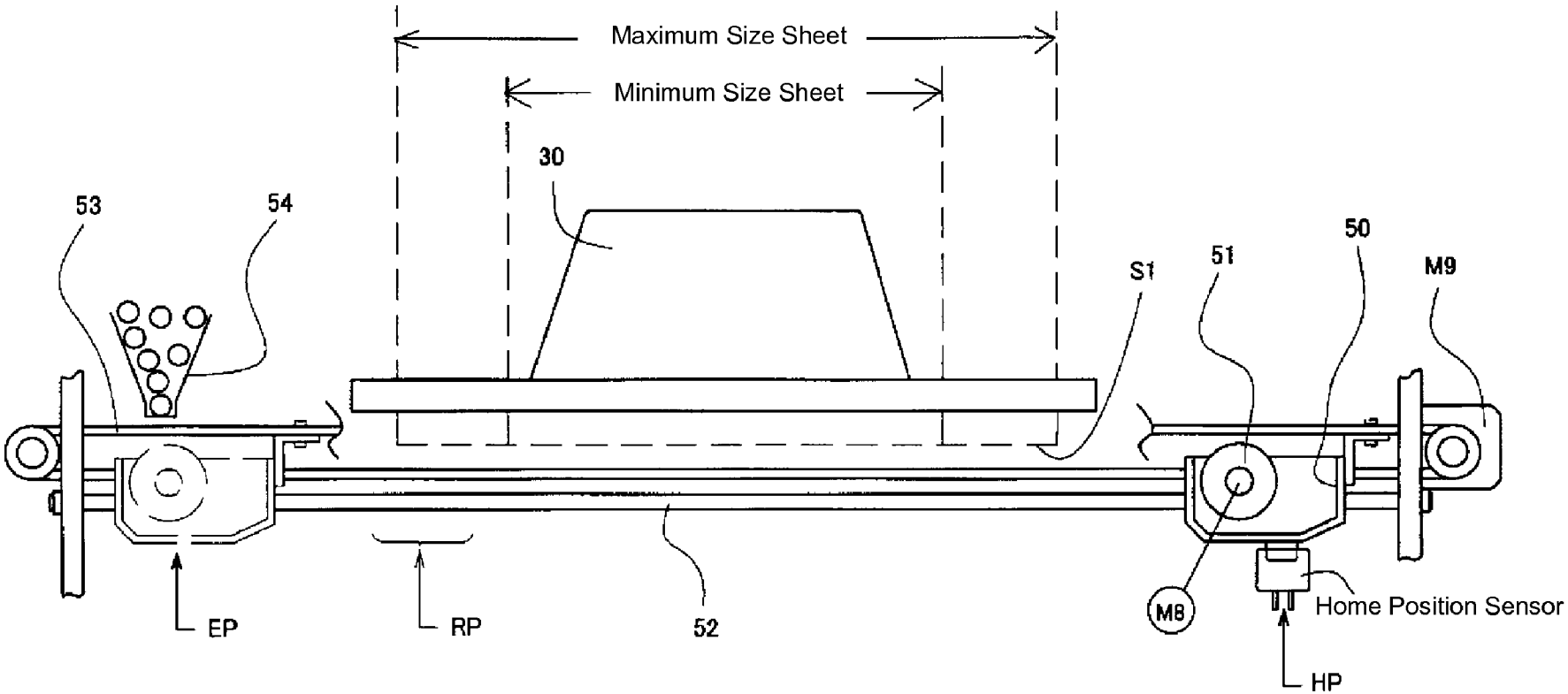
FIG. 4 is an overall view of adhesive application means in the apparatus of FIG. 2.

The adhesive application means E is composed of an adhesive container 50 that holds adhesive; an applicator roll 51 rotatably installed in the container; a drive motor M8 that rotatingly drives the applicator roll 51; and a drive motor M9 that reciprocates the adhesive container 50 along the sheet bundle. FIG. 4 is a conceptual view of the adhesive application means E. The adhesive container 50 is formed to a shorter length (dimension) than the bottom side edge of the sheet bundle (the spine part covered at the binding process) S1. This is supported on a guide rail 52 (see FIG. 4) of the apparatus frame to move along the bottom side edge S1 of the sheet bundle S1 along with the applicator roll 51 installed in that container. The adhesive container 50 is connected to a timing belt 53 installed on the apparatus frame; a drive motor is connected to the timing belt 53.

The adhesive container 50 is shown in the drawings to be configured to move along the sheet bundle, but it is also acceptable to adopt a configuration wherein a tray is longer than the length of the sheet bundle, and only the applicator roller 52 moves in the left and right directions of the drawing. Note that the applicator roll 51 shown in the drawing is composed of a porous and heat resistant material and is configured to be impregnated with adhesive to enable adhesive to form layer on the circumference of the applicator roller.

The drive motor M9 reciprocates the adhesive container 50 between a home position HP and a return position RP where the return operation is started along the sheet bundle, and to a refilling position where adhesive can be charged to the container. Each position is set to the positional relationships shown in FIG. 4; the return position RP is set based on sheet width size information. The adhesive container 50 is set to the home position HP when the power is turned on (at device initialization). For example, this moves from the home position HP to the return position RP after a predetermined amount of time after a sheet grip signal from the grip sensor Sg of the gripping conveyance means 30. At the same time as this movement, the drive motor M8 starts rotating the applicator roll 51.

Figure 5A:
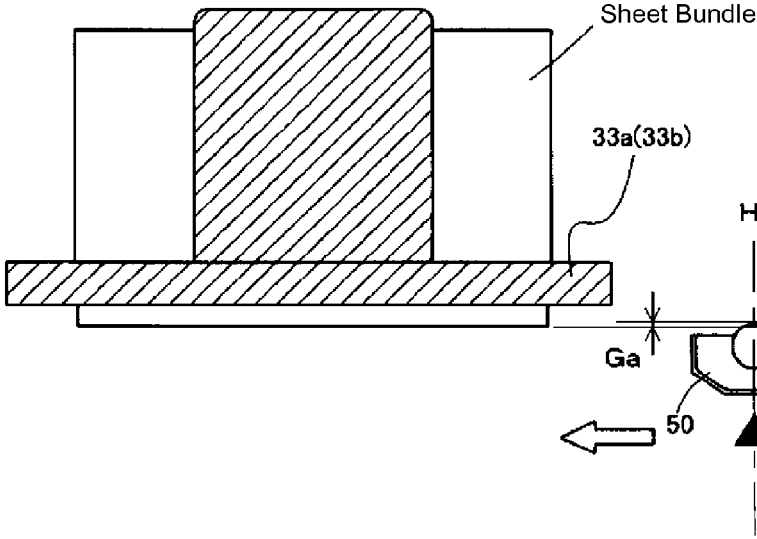
FIGS. 5A and 5D are explanatory drawings showing the application of adhesive in the adhesive application means of FIG. 4.
Figure 5C:
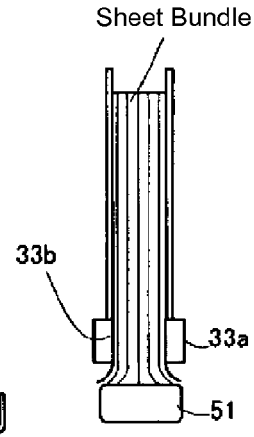
Figure 5B:
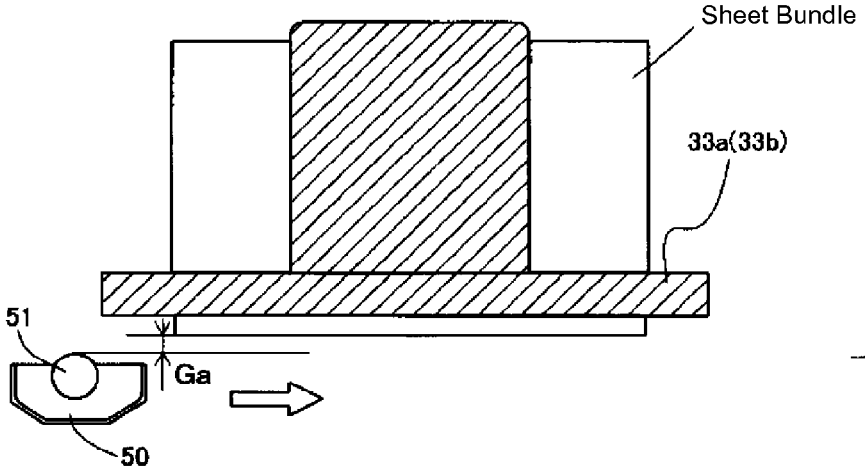
Figure 5D:
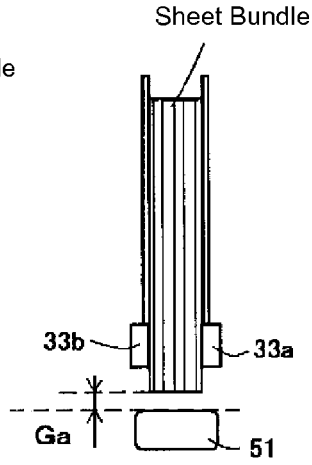

Rotation of the drive motor M9 starts moving the adhesive container 50 from the left side of FIG. 4 to the right side along the guide rail 52. The amount of travel of the gripping conveyance means 30 is controlled or adjusted by the elevator motor so that the applicator roller 51 pressingly contacts the sheet bundle to slightly separate the edges of the sheets (see FIGS. 5A and 5C) in the advancing path, and forms a predetermined gap Ga with the sheet bundle edge in the return path (to return from the return position RP to the home position HP) to apply adhesive (see FIGS. 5B and 5D). The adjustment of the amount of adhesive using the amount of travel of the sheet bundle is based on the sheet bundle thickness information from the sheet bundle thickness detection means St. If the sheet bundle is thick, the gap Ga is widened to increase the amount of adhesive applied. If the thickness is small, the gap Ga is narrowed to reduce the amount of adhesive applied. By controlling the elevator motor M7 of the gripping conveyance means 30, the amount of travel of the sheet bundle can be adjusted. It is also acceptable to equip roll position adjusting means that adjust the position of the applicator roller 51 up or down. When the drive motor M9 moves the adhesive container 50 from the operating position where adhesive is applied to the sheet bundle to the standby position EP separated therefrom at the standby instruction signal, adhesive can be refilled from an adhesive tank 54 arranged at the standby position EP.

Inserter Apparatus

A cover sheet is bound to the sheet bundle applied with adhesive at the adhesive application means E. The following will now explain the feeding of a cover sheet. Sheets formed with images are sequentially conveyed to the discharge outlet 9 of the image forming apparatus A. Normally, a discharge sheet stacker is prepared at the discharge outlet 9. According to the present invention, the sheet conveyance in path P1 is connected to the discharge outlet 9 for the bookbinding apparatus B, and an inserter J is installed at this sheet conveyance in path P1. The inserter J is composed of one or a plurality of stacking trays 16 for stacking sheets (the drawing shows two tiers of stacking trays 16), pickup means 17 that separate sheets on the stacking tray 16 into single sheets, and a sheet feeding path P2 that guides sheets from the pickup means 17 to the sheet conveyance in path P1.

Sheets set on the stacking tray 16 are fed to the sheet conveyance in path P1 between sheets sequentially conveyed from the discharge outlet 9 of the image forming apparatus A. In other words, after a series of sheets are formed with images and conveyed from the image forming apparatus A, sheets are fed from the stacking tray 16 after this final sheet. Special sheets such as thick or coated sheets are prepared as cover sheets in the stacking tray 16. A sheet on the stacking tray 16 is conveyed to the sheet conveyance in path P1 by a control signal sent from the bookmaking apparatus B. The reason why there is a two-tiered approach to the stacking trays 16 is that it is possible to prepare different types of cover sheets in advance on the trays, so the operator can select the type of cover sheet to bind to the sheet bundle from the selected tray.

Cover Sheet Feeding Means

In the system shown in FIG. 1, a sheet feeding path P2 of the inserter J is connected to the sheet conveyance in path P1. The cover sheet is guided from the sheet feeding path P2 to the cover sheet feeding path P4 by the path switching flapper 15. The cover sheet feeding path P4 intersects the sheet bundle conveyance in path P5. The sheet bundle from the sheet bundle conveyance in path P5 and the cover sheet are joined to form an upside-down T shape for binding at the intersecting area (hereinafter referred to as the binding position K). This cover sheet feeding path P4 is composed by upper conveyance guides 63*a*, 63*b* and a lower conveyance guide 63*c* that oppose each other with a predetermined gap. The upper conveyance guides 63*a*, 63*b* are separated into a first upper conveyance guide 63*a* on the right side, and a second upper conveyance guide 63*b* using the intersection section (the binding position K) with the sheet bundle conveyance in path P5 as a boundary, and the right and left conveyance guides individually open and close.

Registration means for positioning the cover sheet at each position of the conveyance direction and the conveyance right angle direction and cover sheet conveyance means for conveying a cover sheet positioned by the registration means at the binding position K are provided in the cover sheet feeding path P4. First, the cover sheet feeding means F is composed of a pair of conveyance rollers disposed in the cover sheet feeding path P4; a driver roller 65*e* is mounted on the lower conveyance guide 65*d* and follower roller 63*c* mounted to the upper conveyance guides 63*a*, 63*b*. A drive motor 10 is connected to the drive roller 65*e*. The upper conveyance guides 63*a*, 63*b* and the follower roller 63*c* are mounted to the apparatus frame by a cam lever, or the like, capable of moving between a position that touches the driver roller 65*e* and a separated position rising thereabove.

Therefore, the upper conveyance guide 63*a*, 63*b* and the follower roller 63*c* are structured to move between an operating position where they come into contact with the cover sheet in the path by the drive motor of the cam lever, not shown, and move the cover sheet to the left side of FIG. 2, and a retracted position where they rise, separated from the cover sheet. In this way, the cover sheet is conveyed to the binding position K at an intersecting point of the cover sheet feeding path P4 and the sheet bundle conveyance in path P5, and is set at a predetermined position there. The upper conveyance guides 63*a*, 63*b* of the binding position K are composed of opening guide plates. They are configured to move between positions that cover the sheet bundle conveyance in path P5 to guide the top of the cover sheet, and positions retracted from the sheet bundle conveyance in path P5. Then, after the second upper conveyance guide 63*b* guides the cover sheet, as shown in FIG. 2, it retracts upward to open the sheet bundle conveyance in path P5.

Binding Unit

The cover-sheet binding means is disposed; a sheet bundle from the sheet bundle conveyance in path P5 and a cover sheet from the cover sheet feeding path P4 are joined in an upside-down T-shape and the cover sheet is folded over the sheet bundle at the binding position K. First, adhesive is applied by the adhesive application means E to the bottom edge S1 of the sheet bundle gripped by the gripping conveyance means 30 at the sheet bundle conveyance in path P5, and the adhesive container 50 is then retracted to its home position HP outside of the path. The gripping conveyance means 30 moves the sheet bundle along the sheet bundle conveyance in path P5 from the adhesive application position X to the binding position K. At the same time, a cover sheet is conveyed to the binding position K and set at the cover sheet feeding path P4.

Figure 6:
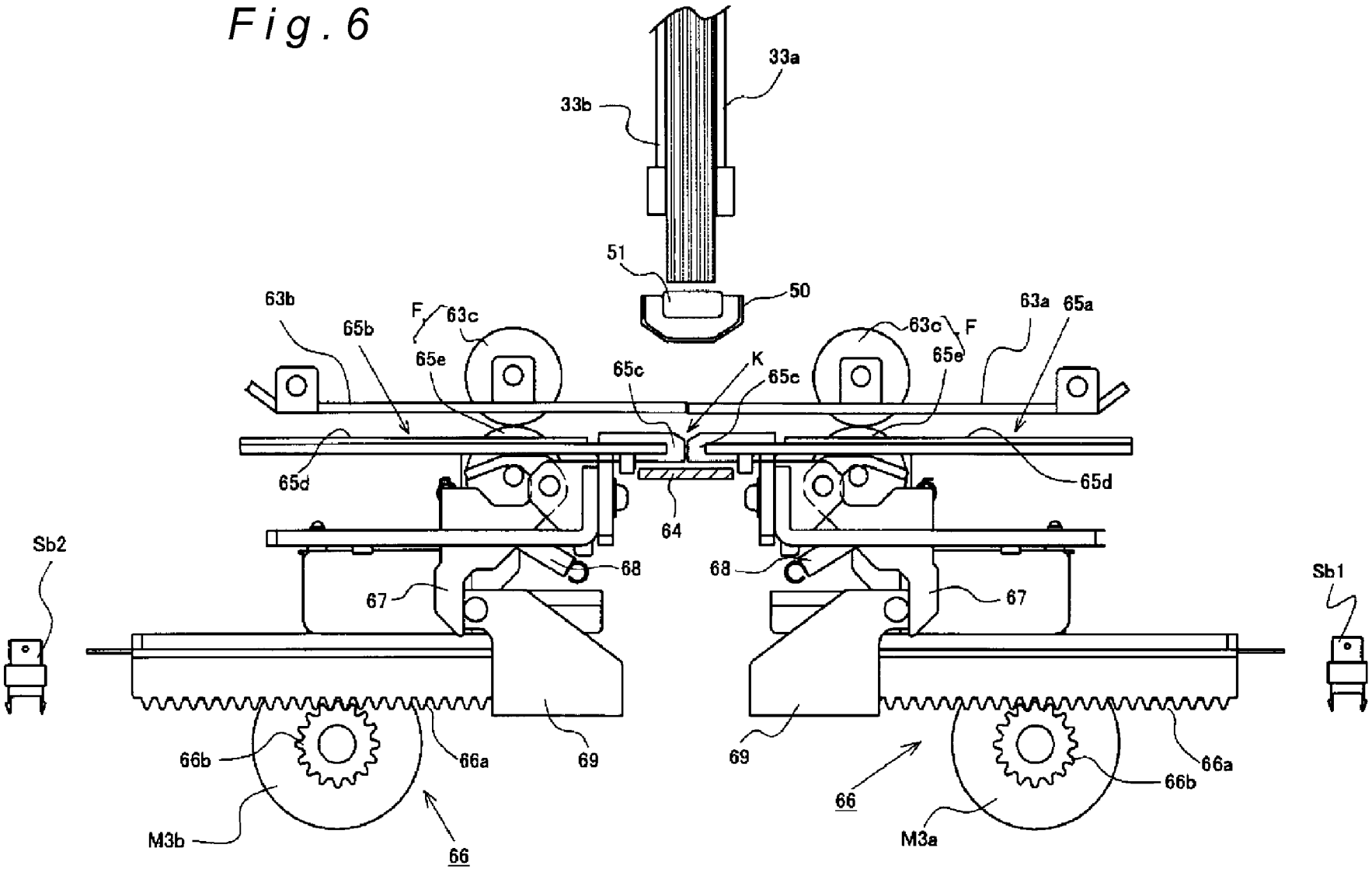
FIG. 6 is an explanatory drawing of cover sheet folding means in the apparatus of FIG. 2, showing the bookbinding path closed.

As shown in FIG. 6, the cover-sheet binding means is composed of a spine rest plate member 64 and spine-creasing press members 65. The spine rest plate member 64 is retractably disposed to move between a backup position advanced into the sheet bundle conveyance in path P5 and a retracted position outside of the path. The spine rest plate 64 supports the cover sheet set stationary at the cover sheet feeding path P4. The sheet bundle conveyed from the sheet bundle conveyance in path P5 by the gripping conveyance means 30 and the cover sheet are joined in the form of an inverted "T." The spine rest plate 64 opens the sheet bundle conveyance in path P5 at the retracted position and by retracting from the sheet bundle conveyance in path P5, the gripping conveyance means 30 is able to convey the sheet bundle toward the folding rollers 70 positioned downstream thereto.

Therefore, the spine rest plate 64 is supported on the apparatus frame to move intersecting the sheet bundle conveyance in path P5 in a perpendicular direction; the spine rest plate 64 is connected to drive means, not shown, such as an electromagnetic solenoid or motor or the like. Of particular note, the spine rest plate 64 is formed by a metal plate with a high coefficient of thermal conductivity and good heat dissipation effect, and can cool the adhesive applied to the sheet bundle. The cover sheet and sheet bundle are joined into an upside-down T-shape while being supported on their spine parts by the spine rest plate 64. The spine-creasing press members 65 that fold the spine part of the cover sheet in this state is disposed at an upstream side of the spine rest plate 64.

Figure 7:
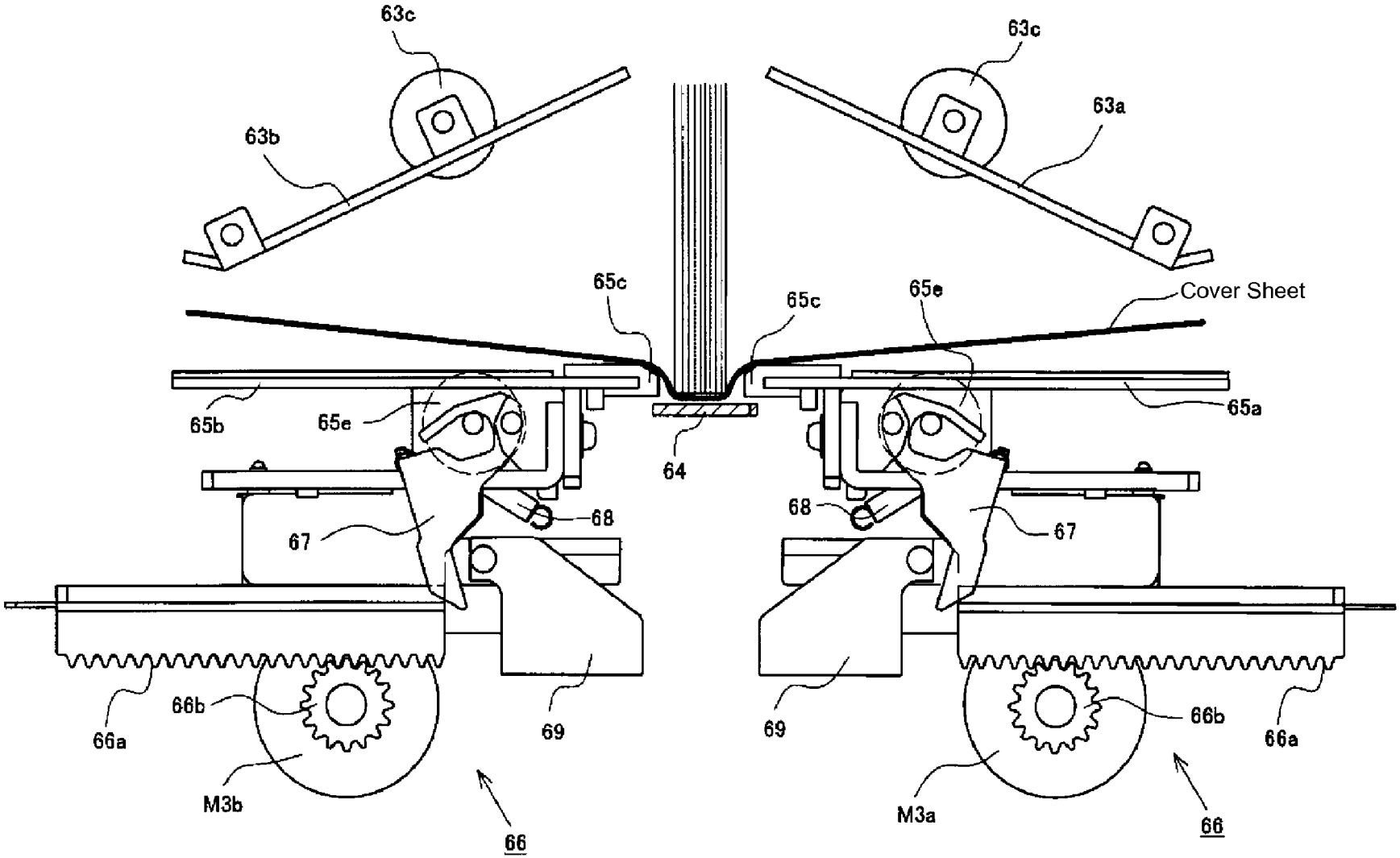
FIG. 7 is an explanatory drawing of cover sheet folding means in the apparatus of FIG. 2, showing the bookbinding path open.

The configuration of the spine-creasing press members 65 of the present invention will now be described. As shown in FIGS. 6, and 7, the spine-creasing press members 65 disposed at the binding position K are composed of a pair of spine creasing pressing members 65*a*, 65*b* (opposing each other on the left and right sides of the binding position K); shifting means 66 that reciprocate the spine-creasing press members 65 between a creasing position (shown in FIG. 6) and standby position (shown in FIG. 7); and control means (hereinafter referred to as the control CPU80) that controls the shift means 66. The right-side spine-creasing press member 65*a*, and left-side spine-creasing press member 65*b* are slidably supported on the apparatus frame (not shown), and a pressing piece 65*c* is equipped on the leading edge of each of these members to fold the spine part of the cover sheet over the spine part of the sheet bundle. Racks 66*a* are integrated to the left- and right-side spine-creasing press members 65*a*, 65*b*; and pinions 66*b* mated thereto are connected to shift motors M3*a*, M3*b*. The shift motors M3*a*, M3*b* are composed of stepping motors. Home position sensors Sb1, Sb2 detect flags disposed on the spine-creasing press members 65*a*, 65*b*. Therefore, shift means 66 is composed of the shift motors M3*a*, M3*b*, and transmission means (the rack and pinion 66*a*, 66*b*).

Note that a guide surface (a lower conveyance guide) 65*d* is disposed to guide the cover sheet conveyed by the cover sheet feeding path P4 to the spine-creasing press members 65*a*, 65*b*. As described above, the pressing members 65*a*, 65*b* are equipped at their leading ends with pressing pieces 65*c*. The guide surface 65*d* is provided to guide the cover sheet toward the cover sheet feeding path P4. Pinch rollers 65*e* (the drive rollers above; the same is used below) are disposed at the guide surface 65*d*; these rollers and the guide surfaces 65*d* guide a cover sheet to traverse the sheet bundle conveyance in path P5 when the press members 65*a*, 65*b* close that path (see the state in FIG. 6). When the guide surfaces 65*d* are retracted outside of the path, the pinch rollers 65*e* are moved below the guide surfaces 65*d*. Actuating levers 67 are engagingly disposed on the pinch rollers 65*e* constantly urged to project into the path by urging springs (not shown) to cause the rollers to move below the guide surfaces 65*e* (see FIG. 7) in resistance to the urging springs. The actuating levers 67 are pulled by springs 68 that are stronger than the urging springs to rotate. Stoppers are equipped on the apparatus frame to engage the actuating levers 67 and rotate them in the clockwise direction at the spine-creasing position.

Thus, the urging springs project the pinch rollers 65*e* upward through the guide surfaces 65*d* when the spine-creasing press members 65*a*, 65*b* are at the spine-creasing position (see FIG. 6); the springs 68 cause the pinch rollers 65*e* to retract downward through the guide surfaces when the spine-creasing press members 65*a*, 65*b* are separated from the spine-creasing position to their standby positions. The reason for this is to project the pinch rollers 65*e* through the guide surfaces 65*d* to smoothly guide the movement the cover sheet at the spine-creasing position, and to retract from the guide surfaces 65*d* so that the cover sheet (set at the binding position) is not wrinkled or otherwise disturbed when the press members 65 move to the standby position to fold the cover sheet.

The control of the spine-creasing press members 65 will now be described. The press members are controlled to be positioned at the spine-creasing position (see FIG. 8A) when a cover sheet is fed from the cover sheet feeding path P4 to the binding position K, and to be positioned at their home positions (see FIG. 8B) retracted from the path when the sheet bundle and cover sheet from the bookbinding path P5 are being joined. The press members then move from their home positions to the standby position and wait for the operation to join the sheet bundle and cover sheet to be completed. When the sheet bundle and cover sheet have been joined, the press members move from the standby position to the spine-creasing position (see FIGS. 8E and 8F). In that process, they are controlled to press-form the spine part of the sheet bundle. The present invention provides at least one of the following to correspond to the thickness of the sheet bundle: (1) means that varies the standby position of the press members; (2) means that varies the operation start time to move the press members from the standby position to the spine-creasing position; and (3) means that varies the traveling speed of the press members to move from the standby position to the spine-creasing position.

Figure 8A:
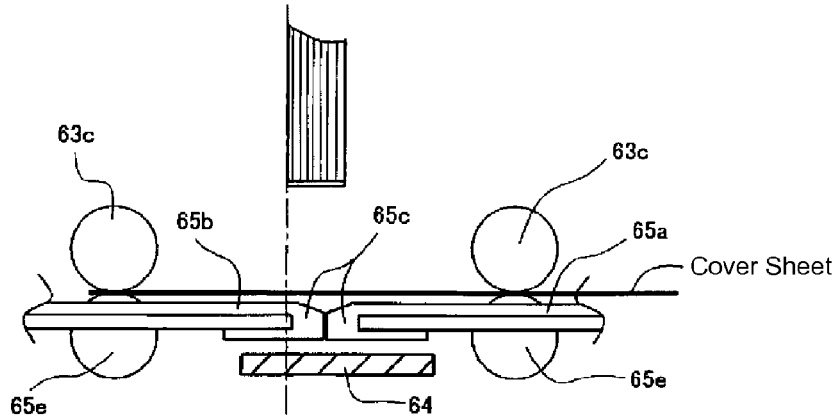
FIGS. 8A to 8C are an explanatory drawings of the order of cover sheet folding operations in the apparatus of FIG. 2, showing a spine-creasing press member move from a home position to and standby position.
Figure 8B:
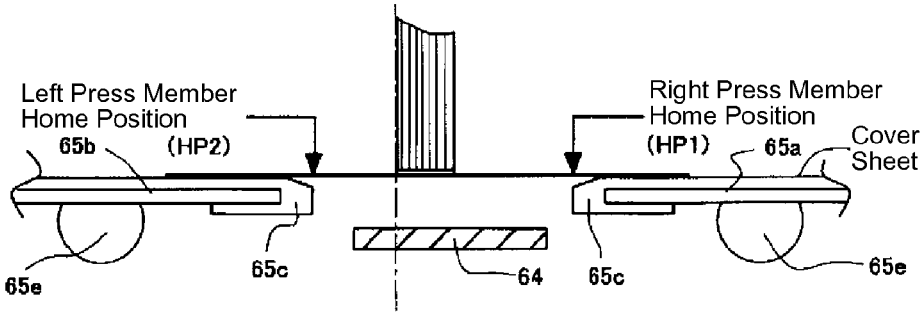
Figure 8C:
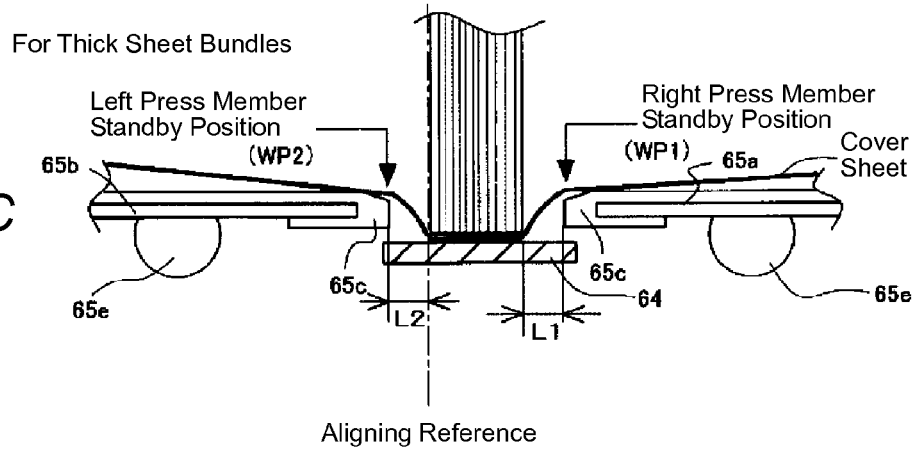
Figure 8D:
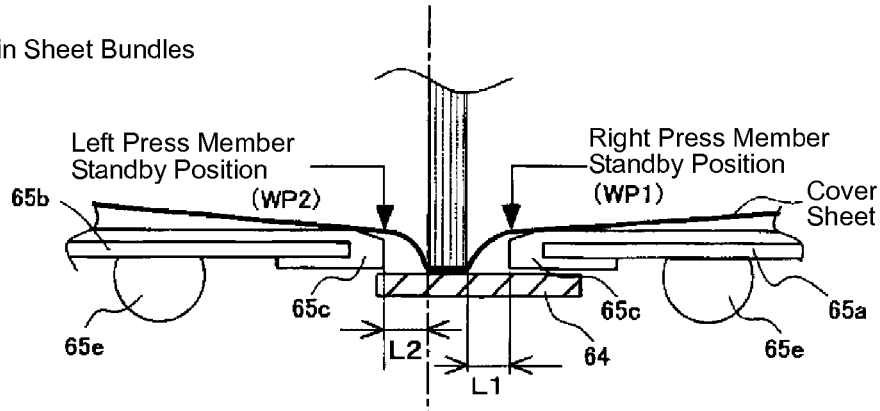
FIGS. 8D to 8F are an explanatory drawings of the order of cover sheet folding operations in the apparatus of FIG. 2, showing a spine-creasing press member move from the standby position to a spine-creasing position.
Figure 8E:
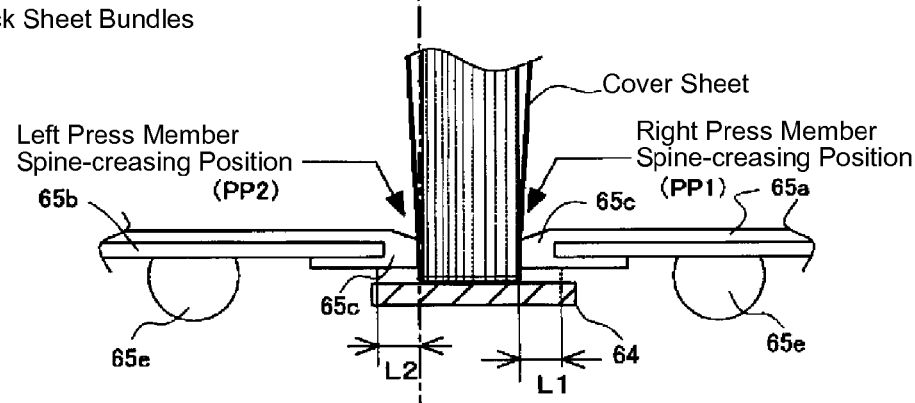
Figure 8F:
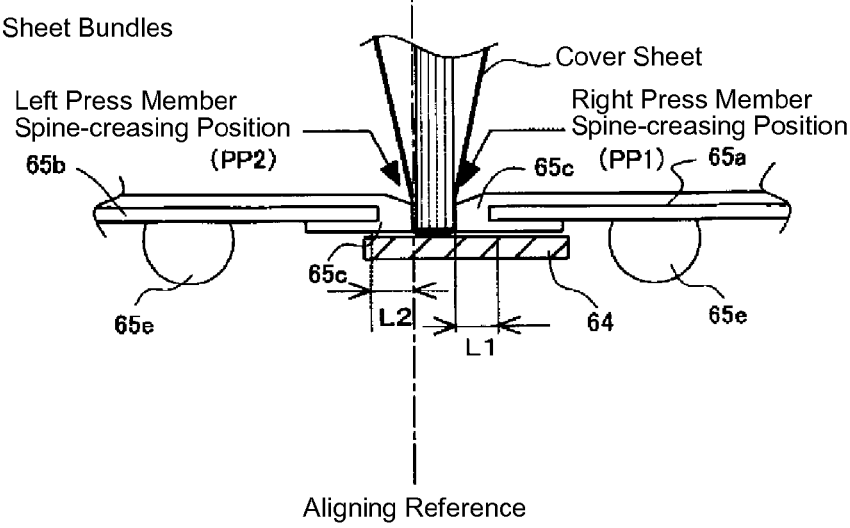

Control means for (1) will now be explained. As shown in FIG. 8B, spine-creasing press members 65 (a pair arranged with one on the left and right) reciprocate between their home positions HP and the standby position WP and spine-creasing position PP. The sheet bundle is fed to the binding position K by the clampers; the movable damper 33*a* position can be changed according to the thickness of the sheet bundle based on the position of the fixed damper 33*b*. Note that the movable damper 33*a* and fixed damper 33*b* compose the gripping conveyance means 30. Therefore, the left spine-creasing press member 65*b* is configured so that the gap L2 between the standby position WP2 and spine-creasing position PP2 is constant regardless of the thickness of the sheet bundle.

However, the right side member, specifically, the spine-creasing press member 65*b* is set to a position that varies the standby position WP1 according to the thickness of the sheet bundle. The gap L1 between the standby position WP1 and spine-creasing position PP1 is set to a distance that is substantially equal to the gap L2. Control means (the control CPU80), described below, moves the spine-creasing press members 65*a*, 65*b* from their home positions HP1, HP2 to the standby positions WP1, WP2 at the signal that the applicator roller 51 has reached its return position RP after the adhesive application process. At that time, the control CPU80 varies the number of drive steps of the shift motor M3*a* based on the thickness information from the sheet bundle thickness detection means St when the right spine-creasing press member 65*a* is moved, to set the standby position WP1 to be constant with the gap (L1) with the spine-creasing position PP1. By varying the standby position WP1 of the spine-creasing press member 65*a* according to the thickness of the sheet bundle, the folding operations for the spine part of the cover sheet can be executed at a constant time, even if the thicknesses of the sheet bundles are different. Therefore, if the standby positions of the spine-creasing press members 65 are fixed, the operating time is short when the sheet bundle is thick, and long when the sheet bundle is thin, thus the state of the hardening of the adhesive will vary depending on the thickness of the adhesive. However, that does not occur with the control means described above.

Control means for (2) will now be explained. In the same way as was described in relation to (1), the spine-creasing press members 65 reciprocate between their home positions HP and the standby position (the standby position described above) WP and spine-creasing position PP. The control means (hereinafter referred to as the control CPU80) that controls the shift motors M3*a*, M3*b* that reciprocate the spine-creasing press members 65 varies the startup timing to move those members 65 from the standby position set to a predetermined position toward the spine-creasing position PP according to the thickness of the sheet bundle. Specifically, although this is not shown in the drawings, the spine-creasing press members 65*a*, 65*b* are set to constant gap distances preset for gaps L1, and L2 of their standby positions WP1, WP2, and spine-creasing positions PP1, PP2.

The control CPU80 moves the left and right side spine-creasing press members 65 from the standby position WP to the spine-creasing position PP after a predetermined delay time based on a timing signal that the applicator roller 51 has reached the return position RP after the adhesive application process, or a timing signal that the applicator roller 51 has returned to its home position HP. At that time, the control CPU80 varies the number of drive steps of the shift motor M3*a* based on the thickness information from the sheet bundle thickness detection means St when the right spine-creasing press member 65*a* is started. The startup timing of the right spine-creasing press member 65*a* is delayed when the sheet bundle is thick, and moved forward in time when the sheet bundle is thin. The timer of the timer means that generates the delay time is set to correspond to the sheet bundle thickness when t1 for a thick sheet bundle, and to t2 when the sheet bundle is thin. Thus, it is possible to make the operating time for the right- and left-side spine-creasing press members 65 to move from the standby position WP to the spine-creasing position PP a constant time.

Control means for (3) will now be explained. In the same way as was described in relation to (1), the spine-creasing press members 65 reciprocate between their home positions HP and the standby position (the standby position described above) WP and spine-creasing position PP. The control means (hereinafter referred to as the control CPU80) that controls the shift motors M3*a*, M3*b* that reciprocate the spine-creasing press members 65 varies the speed to move those members 65 from the standby position set to a predetermined position toward the spine-creasing position PP according to the thickness of the sheet bundle. Specifically, although this is not shown in the drawings, the spine-creasing press members 65*a*, 65*b* are set to constant gap distances preset for gaps L1, and L2 of their standby positions WP1, WP2, and spine-creasing positions PP1, PP2.

The control CPU80 moves the left- and right-side spine-creasing press members 65 from the standby position WP to the spine-creasing position PP after a predetermined delay time based on a timing signal that the applicator roller 51 has reached the return position RP after the adhesive application process, or a timing signal that the applicator roller 51 has returned to its home position HP. At that time, the control CPU80 varies the drive speed of the shift motor M3*a* based on the thickness information from the sheet bundle thickness detection means St when the right spine-creasing press member 65*a* is moved. The traveling speed of the right spine-creasing press member 65*a* is slowed when the sheet bundle is thick, and increased when the sheet bundle is thin. The pulse power duty supplied to the shift motor M3*a* is set to be low for a thick sheet bundle and high for a thin sheet bundle. Thus, it is possible to vary the operating speed for the right- and left-side spine-creasing press members 65 to move from the standby position WP to the spine-creasing position PP according to the sheet bundle thickness, and to maintain a constant operating time.

Note that the according to the present invention, (1) the standby position is set to be constant, and the (3) operating time is set to be constant for the traveling speed according to the thickness of the sheet bundle, but if the sheet bundle is thin, it is acceptable to shorten the operating time, and to set the operating time to correspond to the hardening state of the adhesive applied to the sheet bundle. Also, the control CPU80 controls to reduce the traveling speed of the spine-creasing press members 65 as they approach the spine-creasing position when moving from the standby position to the spine-creasing position. The shift means M3 is composed of a stepping motor. The pulse power duty supplied to the motor drive circuit is reduced as the spine-creasing press members 65 approach the spine-creasing position PP. This allows the press members 65 to gently press the cover sheet so the cover sheet can be applied to the spine part of the sheet bundle without wrinkling or other folding problems.

Also, the control CPU80 adjusts the pulse power duty to increase the traveling speed when the spine-creasing press members 65 separate from the spine-creasing position when moving from the spine-creasing position to the standby position. This enables the spine-creasing press members 65 to retreat gently (at a low speed) from contact with the sheet bundle and move to their standby positions with a gradually increasing higher speed when they are returned from the spine-creasing position to their standby positions. This makes it possible to increase the speed of the spine-creasing press members' 65 movement.

The configuration of the control CPU80 that controls the shift motors M3*a*, M3*b* will now be described. The control CPU80 controls the movement of the spine-creasing press members 65 from the standby position WP to the spine-creasing position PP. In that operation, the spine-creasing press members 65 return to the standby position WP after the cover sheet has been folded over the sheet bundle. At that time, the control CPU80 maintains the pressing state for a predetermined holding time (hereinafter referred to as the pressing time) while the spine-creasing press members 65 have folded the cover sheet (at the spine-creasing position). After a predetermined pressing time has elapsed, the spine-creasing press members 65 are returned to their standby positions. The control CPU80 adjusts (to lengthen or shorten) the pressing time according to the grammage and quality of the cover sheet and/or the thickness of the sheet bundle. A control panel 81 is equipped on the control CPU80. Information such as the grammage and quality of the cover sheet and the like are input using input means of the control panel 81; the control CPU80 executes the spine creasing operation based on the pressing time set according to that input info. The pressing time is changed according to the sheet bundle thickness. The pressing time is longer for heavier grammage cover sheets, longer for cover sheets with an abundantly stiff quality, and long for sheet bundles that are thick.

Figure 9:
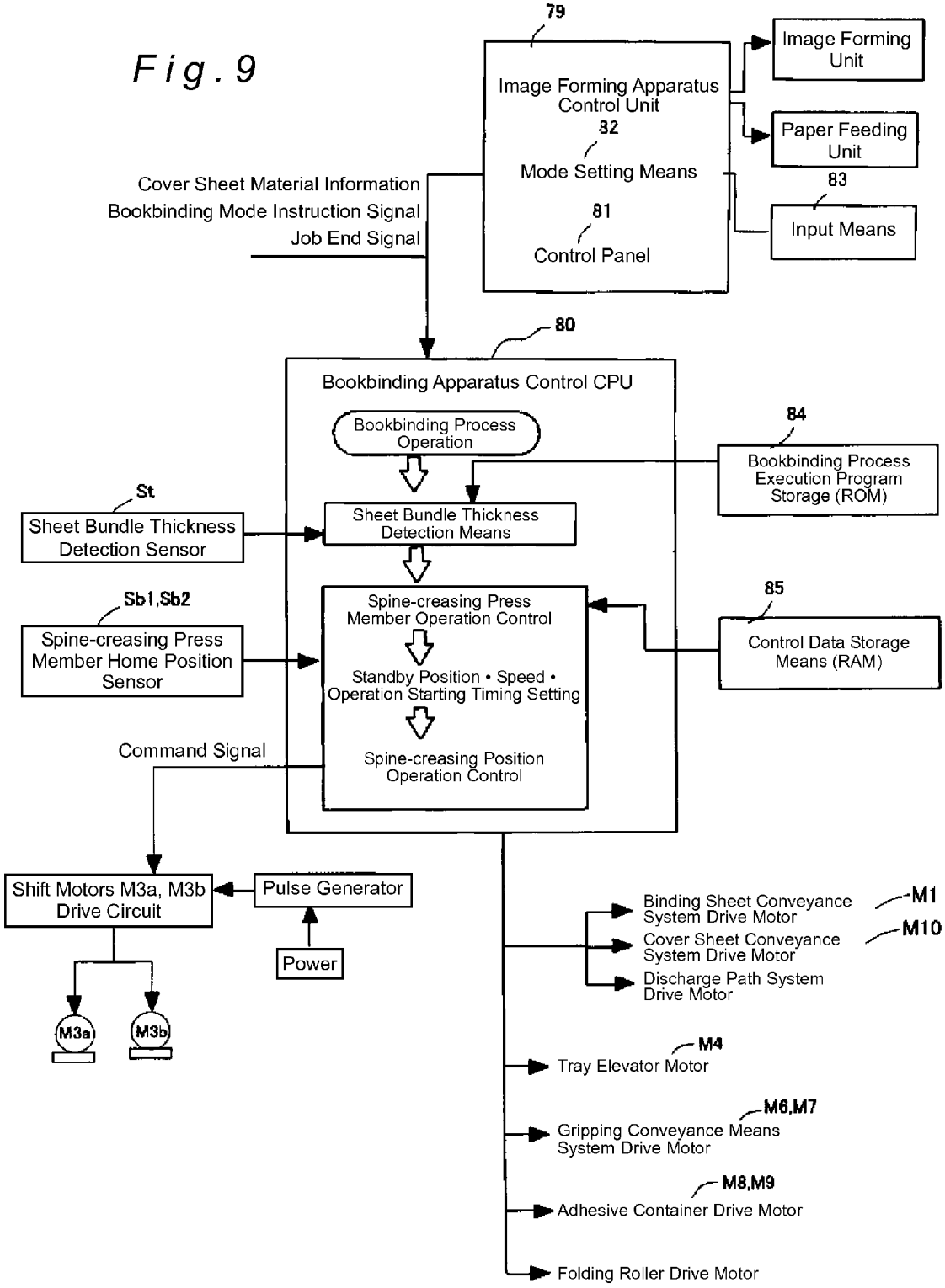
FIG. 9 is a block diagram of a configuration of the control means in the apparatus of FIG. 2.

The overall configuration of the control CPU80 will now be explained with reference to the block diagram of FIG. 9. As shown in FIG. 1, in the system that connects the image forming apparatus A and the bookmaking apparatus B, the control panel 81 and mode selection means 82 are equipped on the control unit of the image forming apparatus A. The control CPU79 of the image forming apparatus A executes the bookbinding operation on the bookbinding apparatus B according to the process selections of "printing process mode," and "bookmaking process mode" as set by the control panel 81. With the printing process mode, the path switching flapper 15 guides printed sheets conveyed by the sheet conveyance in path P1, to the finishing apparatus I from the sheet feeding path P4 and discharge path P6; those sheets are stored in the stacker equipped in the finishing apparatus 1. Therefore, printed sheets pass through the bookmaking apparatus B.

When the bookmaking process mode is selected, the bookmaking apparatus B guides the printed sheet from the sheet conveyance in path P1 to the binding sheet conveyance path P3, stacks the sheets, applies the adhesive, binds a cover sheet to the stacked sheets, then stores the finished booklet in the storing stacker H. When the bookmaking mode is selected, the control CPU79 of the image forming apparatus A transmits an instruction signal of the bookmaking mode and size information of the printed sheets simultaneously to the bookmaking apparatus B. An operator inputs information relating to thickness such as the basis weight (grammage) of the cover sheet and the like, and material quality such as whether the material is stiff or pliable using the input means 83. That information is transmitted to the control CPU80 (the control means). At the same time as this, information for the number of copies, for example when printing n pages, when the final nth page is ended, a job end signal is transferred to the control CPU80 (the control means) of the bookmaking apparatus B.

The control CPU80 (the control means) is composed of a bookbinding control unit, and inserter control section. A conveyance system drive circuit is connected to the control CPU80. Included in that circuit are the systems for the drive motor of the conveyance roller of the sheet conveyance in path P1, the drive motor M1 of the discharge roller 21 of the binding sheet conveyance path P3, and the drive motor M of the conveyance roller 69 of the cover sheet conveyance path P4. The control CPU80 is also connected to the drive circuits of the tray elevator motor M4 that raises and lowers the tray 22, and the grip motor M6 and the elevator motor M7 of the gripping conveyance means 30. Also connected to the control CPU80 are the drive motor M8 of the applicator roller, the drive motor M9 that reciprocates the adhesive container and the shift motors M3*a*, M3*b* of the spine-creasing press members 65. Of particular note, the shift motors M3*a*, M3*b* are stepping motors connected to the control CPU80 to receive commands issued therefrom for pulse power duty to the power pulse generator, drive start time and ending timing.

The sheet bundle thickness detection means St, the grip end sensor Sg, the home position sensors Sb1, Sb2, and other sensors disposed in the paths P1 to P5 are connected so that their detection signals are transmitted to the control CPU80. A control program storing means (ROM) 84 that executes the operation to stack sheets in the stacking tray 22; the operation to convey a sheet bundle from the stacking tray 22 to the adhesive application position X and binding position K using the gripping conveyance means 30; the operation to apply adhesive at the adhesive application position; the operation to join the cover sheet and sheet bundle at the binding position K; the spine creasing operation to fold the cover sheet over the spine part of the sheet bundle after the joining process; and the operation to convey out the finished sheet bundle is provided at the control CPU80. A control data storage means (RAM) 85, such as speed information for the shift motors M3 that drive the spine-creasing press members 65, and startup timing (timer table) is also provided at the control CPU80.

The control CPU80 executes the bookbinding process according to the procedures shown in FIG. 8. FIG. 8A shows adhesive applied to the sheet bundle at the bookbinding path P5, and a cover sheet being conveyed and set at the binding position K of the cover sheet feeding path P4. In this state, the upper guide surfaces 65*d* and pinch rollers guide the cover sheet while the spine-creasing press members 65 close the bookbinding path P5 at the binding position K. At the point where the cover sheet is set at the predetermined position, the control CPU80 moves the spine-creasing press members 65 from the bookbinding path P5 to their home positions HP (see FIG. 8B). In this state, the cover sheet supported by the spine rest plate 64 is joined to the sheet bundle forming an upside-down T-shape. In the drawing, the cover sheet is in contact with the spine rest plate 64, and the edge of the sheet bundle applied with adhesive is supported by the gripping conveyance means 30 to form the smallest allowable gap therebetween the spine rest plate 64. Adhesive exists in this gap. Thereafter, the control CPU80 moves the spine-creasing press members 65 from their home position HP to their standby position (see FIGS. 8C and 8D) at the timing signal indicating the applicator roller has returned to its return position RP. At this time, the control means of (1) above moves the standby position of the right press member 65*a* to a position near the home position when the sheet bundle is thick (see FIG. 8C), and away from the home position if the sheet bundle is thin (see FIG. 8D). The control CPU80 moves the spine-creasing press members 65 from the standby position to the binding position (see FIGS. 8E and 8F) after the joining operation with the sheet bundle is completed.

Note that in the operations explained above, the control CPU80 controls for case (1), but for case (2) the speed to move the members from the standby position to the binding position is changed according to the thickness of the sheet bundle; the speed is slowed for thick sheet bundles, and increased for thin sheet bundles. It is acceptable to change the pulse duty supplied to the shift motor M3*a* as a means to attain that object. For the control of case (3), the shift motor M3 is started after a delayed time depending on the thickness of the sheet bundle, at the return signal (the application of adhesive is completed) of the applicator roller 51 to its home position in the foregoing operation. The control described above enables executions of the cover sheet folding operations, using the spine-creasing press members 65, with substantially equal operating times regardless of whether a sheet bundle is thick or thin.

(This application claims priority rights from Japanese Pat. App. No. 2006-128706, which is herein incorporated by reference.)

What is claimed is:

1. A bookbinding apparatus comprising:

sheet stacking means for stacking sheets into bundles;

adhesive applicator means for applying adhesive to a spine part of a sheet bundle from said sheet stacking means;

cover-sheet feeding means for feeding cover sheets to a binding position located below said adhesive applicator means;

cover-sheet binding means for binding a cover sheet, in the binding position, together with a spine part of the sheet bundle from said adhesive applicator means, said cover-sheet binding means including a spine-rest plate member for, in order to join the cover sheet in the binding position together with the spine part of the sheet bundle from said adhesive applicator means, supporting the cover sheet from underneath, and a left-and-right pair of spine-creasing press members, disposed above said spine-rest plate member, for folding the cover sheet over, having been joined with, the sheet bundle;

shift means for shifting said left-and-right pair of spine-creasing press members between a predetermined home position, a spine-creasing position where, after joining of the cover sheet and the sheet bundle, said spine-creasing press members fold the cover sheet over the bundle, a standby position situated in between the home position and the spine-creasing position, and a cover-sheet guide position in which, when a cover sheet is being fed by said cover-sheet feeding means to the binding position, said spine-creasing press members guide the cover sheet, wherein the separation, from the home position, of the spine-creasing position of a first of the spine-creasing press members constituting said left-and-right pair of spine-creasing press members is set fixed, and the separation, from the home position, of the spine-creasing position of a second of the spine-creasing press members constituting said left-and-right pair of spine-creasing press members is set to a location varying in accordance with the thickness of the sheet bundle, and the separation, from the spine-creasing position, of the standby position of the first of the spine-creasing press members is set fixed; and control means for controlling said shift means, said control means being furnished with at least one of: (1) means for varying, in accordance with the thickness of the sheet bundle, the standby position of said second of the press members; (2) means, whose distance from the standby position of the first of the spine-creasing press members to the standby position of the second of the spine-creasing press members is set fixed, for varying, in accordance with the thickness of the sheet bundle, the start time of an operation to shift said second of the spine-creasing press members from the standby position of said second of the spine-creasing press members to the spine-creasing position; and (3) means, whose distance from the standby position of the first of the spine-creasing press members to the standby position of the second of the spine-creasing press members is set fixed, for varying, in accordance with the thickness of the sheet bundle, the traveling speed of said second of the spine-creasing press members in shifting from the standby position of said second of the spine-creasing press members to the spine-creasing position.

2. The bookbinding apparatus according to claim 1, wherein said control means is furnished either with sheet-bundle thickness detection means for directly detecting the thickness of the sheet bundle, or with counting means for counting the number of sheets in the sheet bundle.

3. The bookbinding apparatus according to claim 1, wherein said control means controls said shift means to accord the standby position of the spine-creasing press members to, so that their separation from the spine-creasing position varies in accordance with, the thickness of the sheet bundle, the control operation therein being configured to bring the standby position nearer, so that the separation from the spine-creasing position is shortened, the thinner the sheet bundle is.

4. The bookbinding apparatus according to claim 1, wherein said control means controls said shift means, in shifting the spine-creasing press members from their predetermined standby positions to the spine-creasing position, to vary the operation start time in accordance with the thickness of the sheet bundle, the control operation therein being configured to advance the operation start time the thinner the sheet bundle is.

5. The bookbinding apparatus according to claim 1, wherein said control means controls said shift means, in shifting the spine-creasing press members from their predetermined standby positions to the spine-creasing position, to vary the travel speed in accordance with the thickness of the sheet bundle, the control operation therein being configured to quicken the travel speed the thinner the sheet bundle is.

6. The bookbinding apparatus according to claim 1, wherein:

said sheet stacking means, adhesive applicator means, and cover-sheet binding means are sequentially disposed in a sheet-bundle conveyance path for conveying sheet bundles;

a cover-sheet feeding path for conveying cover sheets to said cover-sheet binding means is disposed intersecting the sheet-bundle conveyance path; and a gripping conveyance means for transporting sheet bundles is provided in the sheet bundle conveyance path.

7. The bookbinding apparatus according to claim 6, wherein:

the cover-sheet binding means has a spine rest plate for providing backing support to a cover sheet from the cover sheet feeding path; and the gripping conveyance means presses the spine part of a sheet bundle onto a cover sheet on the spine rest plate.

8. The bookbinding apparatus according to claim 1, wherein said control means controls the shift means to retain said spine-creasing press members in the spine-creasing position for a preset retaining time in a state in which said spine-creasing press members have spine-creased the cover sheet on the sheet bundle, the retaining time being set so as to be variable in accordance with the grammage and material of the cover sheet, and/or with the thickness of the sheet bundle.

9. The bookbinding apparatus according to claim 8, wherein the retaining time during which said control means controls said shift means to retain said spine-creasing press members in the spine-creasing position is preset in accordance with the grammage of the cover sheet, the control operation therein being configured to lengthen the retaining time the greater the grammage of the cover sheet is.

10. The bookbinding apparatus according to claim 8, wherein the retaining time during which said control means controls said shift means to retain said spine-creasing press members in the spine-creasing position is preset in accordance with the thickness of the sheet bundle, the control operation therein being configured to lengthen the retaining time the thicker the sheet bundle is.

11. The bookbinding apparatus according to claim 1, wherein the control means slows down the traveling speed of the spine-creasing press members as the press members draw near the spine-creasing position in shifting from the standby position to the spine-creasing position.

12. The bookbinding apparatus according to claim 1, wherein the control means speeds up the traveling speed of the spine-creasing press members as the press members part away the spine-creasing position in shifting from the spine-creasing position to the standby position.

13. The bookbinding apparatus according to claim 1, wherein:

said spine-creasing press members are disposed in a binding position where the sheet-bundle conveyance path for conveying sheet bundles from said adhesive applicator means and the cover-sheet feeding path for conveying cover sheets intersect; and said press members are furnished with guide surfaces fronting on the cover-sheet feeding path to guide cover sheets.

14. The bookbinding apparatus according to claim 13, wherein rollers for guiding cover sheets to said guide surfaces are disposed on the spine-creasing press members, said rollers being configured to surface and sink from the guide surfaces shifting into and out of the sheet bundle conveyance path, operationally linked to the spine-creasing press members.

15. The bookbinding apparatus according to claim 1, wherein the cover-sheet guide position of said left-and-right pair of spine-creasing press members is in a location covering said spine-rest plate member.

* * * * *